US005345804A

United States Patent [19]

Carrere

[11] Patent Number: 5,345,804

[45] Date of Patent: Sep. 13, 1994

[54] ROLLER STRAIGHTENING DEVICE FOR STEEL BARS FOR CONCRETE

[76] Inventor: Noël Carrere, Résidence Crespy 2, Bâtiment 11 Appartement 332, 33400 Talence, France

[21] Appl. No.: 938,250

[22] PCT Filed: May 3, 1991

[86] PCT No.: PCT/FR91/00368

§ 371 Date: Jan. 4, 1993

§ 102(e) Date: Jan. 4, 1993

[87] PCT Pub. No.: WO91/17003

PCT Pub. Date: Nov. 14, 1991

[30] Foreign Application Priority Data

May 3, 1990 [FR] France ..... 90 05569

[51] Int. Cl.[5] ..... B21D 3/05

[52] U.S. Cl. ..... 72/164; 140/147

[58] Field of Search ..... 72/164, 165, 160; 140/147

[56] References Cited

U.S. PATENT DOCUMENTS 4,719,781 1/1988 Cloup ..... 72/164

FOREIGN PATENT DOCUMENTS 2550973 3/1985 France ..... 72/164

2576811 8/1986 France .

718204 2/1980 U.S.S.R. ..... 72/164

*Primary Examiner*—Daniel C. Crane

*Attorney, Agent, or Firm*—Hoffman, Wasson & Gitler

[57] ABSTRACT

The invention relates to a straightener with rollers, that can be used in particular for straightening steel bars for concrete. It includes in combination several plates which can be moved while remaining perpendicular to the axis of the product to be straightened, each plate having on both of its working faces, articulated at one of its points a pivoting roller-bearing arm the other extremity of which is maintained so that it can move in the vicinity of the adjacent plate when the distance separating the two plates in question is varied, this arm having a straightening roller situated essentially at a quarter of the distance between the point of articulation of the arm onto the plate and the extremity of the arm which is situated near the neighboring plate, a means such as an eccentric enabling the position of the axis of the roller relative to the axis of the product to be straightened to be preset and a means enabling the plates to be moved parallel to the axis of the product to be treated so that equal distances are maintained between them, the axis of the product to be straightened being situated at equal distances from the points of articulation of the arms onto the plates.

11 Claims, 5 Drawing Sheets

ROLLER STRAIGHTENING DEVICE FOR STEEL BARS FOR CONCRETE

BACKGROUND OF INVENTION

The present invention relates to a straightener with rollers designed in particular for the straightening of steel bars for concrete.

It is known that elongated metal products obtained by rolling and in particular steel bars for concrete, require straightening before use to bring them into true.

In practice it is difficult to achieve perfect straightening because of constraints of all kinds which exists in the product to be straightened before being introduced into the straightener.

Straighteners which operate by alternating flexion in the same plane are already known. The straighteners circulate the wire to be straightened between rollers which are on either side of the axis of the machine which causes alternating flexion resulting in the elastic limit of at least part of the section of the product to be straightened to be exceeded by subjecting it to permanent deformations which diminish progressively to reach a virtually nil value as the product to be straightened passes through the straightener.

It is also known that to achieve satisfactory straightening it is necessary to regulate precisely the position of the various rollers relative to the axis of the progress of the product to be straightened, and also the distance separating the various rollers along the axis of the straightener.

The result is a considerable waste of time and considerable difficulty in adjustment when the straightener has to deal successively with products of different diameter.

This disadvantage is particularly serious in the case where the product to be straightened consists of steel bars for concrete which have dimensional characteristics that can vary quite considerably in the same lot.

Devices known from U.S. Pat. No. 4,719,781 permit the simultaneous displacement and adjustment of several rollers in order to adapt the straightener to the dimensional characteristics of the product to be straightened, but to date these devices do not give complete satisfaction because they do not take into account all the adjusting required to obtain satisfactory straightening.

Furthermore, these known devices do not in general permit the axis of the straightened product to be kept in a fixed position when the setting of the rollers is modified to take into account the dimensional variations of the product that is to be straightened, when entails adjustment of the devices upstream and downstream of the straightener, or failing this an alteration of the straightness of the product.

It is also known that to obtain correct straightening it is necessary to apply successive alternating flexion in at least two different planes.

SUMMARY OF THE INVENTION

The present invention relates to a straightener which by more simple and economical means enables this problem to be addressed and which permits more rapid and efficient adjustment of the longitudinal position and the distance between the various rollers depending on the dimensional characteristics of the product to be straightened, to be retained.

The object of the present invention is a straightener with rollers that can be used for elongate metal products and in particular for the straightening of steel bars for concrete, characterized by the fact that it includes in combination several plates which can be moved while remaining perpendicular to the axis of the product that is to be straightened, each plate having on both of its working faces, articulated at one of its points, a pivoting roller bearing arm, the other extremity of which is held so that it can move in the vicinity of the adjacent plate when the distance separating the two plates in question is varied, this arm supporting a straightening roller situated essentially at a quarter of the distance between the point of articulation of the arm onto the plate and the extremity of the arm which situated in the vicinity of the neighboring plate, an adjustment means, such as an eccentric permitting pre-regulation of the position of the axis of the roller relative to the axis of the product to be straightened, so that equal distances are maintained between them, the axis of the product to be straightened being placed at equal distances from the articulation point of the arms on the plates.

Because the straightening rollers, in accordance with the invention, are fixed essentially at a quarter of the length of the oscillating arm taken from the point where the arm is fixed to the plate, by varying the distance between the different plates while maintaining the distances between them equal, the rollers are all made to move by the same amount in the direction of the axis of the product to be straightened while remaining equidistant.

In other words, as a result of the invention, the rollers all approach the axis of the product to be straightened in accordance with the same law which is dependant on the variation of the distance between the plates.

According to one particular method of carrying out the invention, the arms which are articulated by one extremity to the plates are each joined to the neighboring plates by a short rod, so that taking into account the limited amplitude of the adjustment movements, a first approximation could be to consider that the extremities of the arms move in a direction essentially parallel to the plane of the plates.

In one variation it is possible to mount the free extremity of each arm on a shoe which is maintained to slide on a surface parallel to the plane of the plate.

According to the invention, it is possible to ensure, as a result of the various arrangements, movement of the plates while keeping them equidistant.

To this end, separate driving means can for example be used for each plate, which are activated by engines step by step, the rotation of each engine being independently controlled in order to ensure that the plates remain equidistant from each other.

Each plate can also be controlled by a nut and bolt device which has steps in arithmetic progression for each plate, so that for a given rotation of the bolts the plates move from a fixed point in this same arithmetic progression.

However, according to a preferred method of carrying out the invention the equidistance between the plates is ensured by a pivoting lever connected by small rods to the various plates, each small rod being articulated to the pivoting lever at a point of articulation of the lever is proportional to the distance between the point of articulation of the small rod onto its plate and the point of articulation of the small rod onto the pivoting lever.

In a preferred method of carrying out the invention, the plates are mounted to slide on two fixed cylindrical shafts.

BRIEF DESCRIPTION OF THE DRAWINGS

With a view to a better understanding of the invention, one method of carrying it out will now be described by way of illustration, and in no way limiting it, taken as an example and shown in the attached drawing.

In the Drawings.

DETAILED DESCRIPTION OF THE INVENTION

Figure 1:
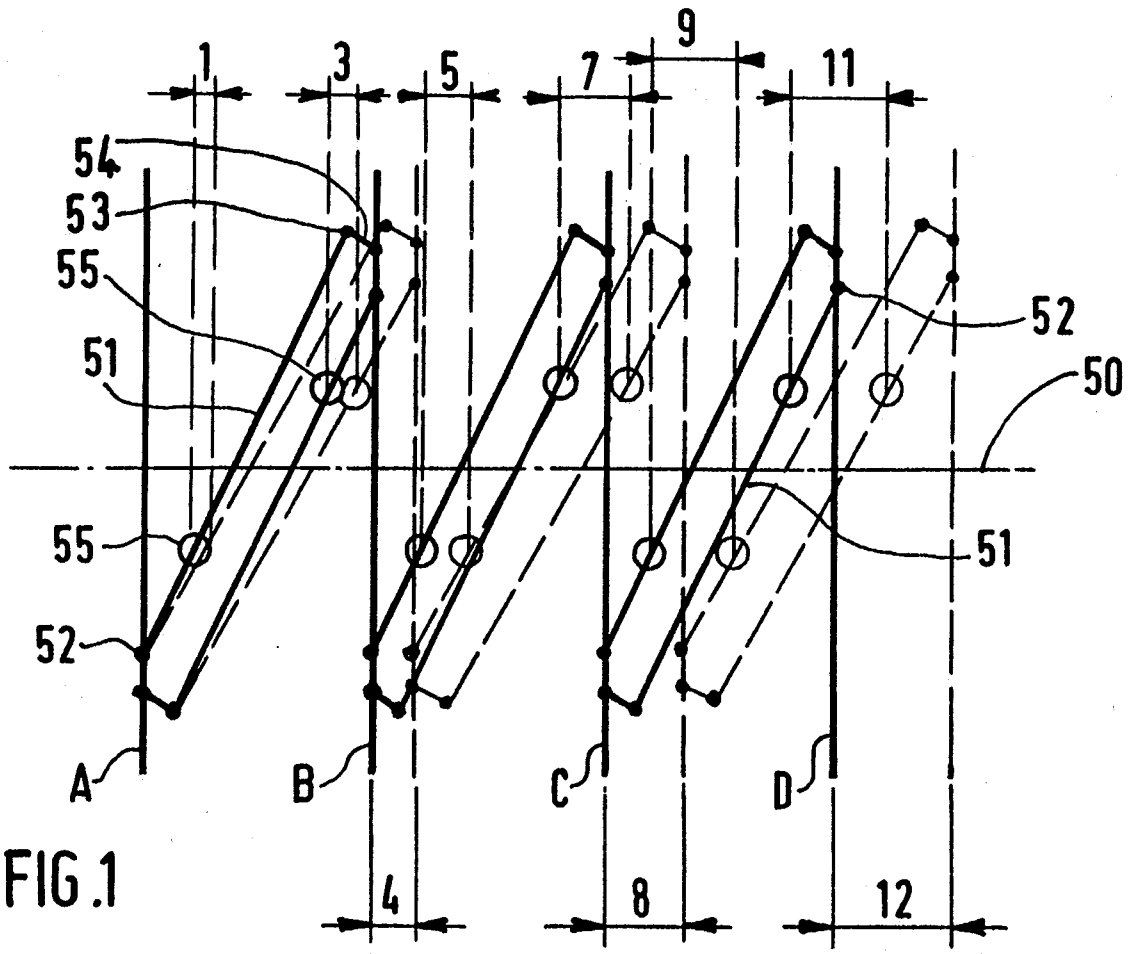
FIG. 1 is a diagram showing the principle of the operation of the invention.

In FIG. 1 there is a diagram showing plates A, B, C, D which can slide parallel with the axis of the straightener 50, while remaining equidistant. This result can be obtained by different means which will be described hereafter.

Each plate has a roller-bearing arm 51 articulated at 52 and the other extremity 53 of which is connect to the neighboring plate by a short small rod 54 articulated on the one hand onto the neighboring plate and on the other hand to the extremity 53 of the arm 51.

According to the invention, the arm 51 supports roller straightener 55 which is situated at approximately a quarter of the distance between the point of articulation 52 onto its plate and the extremity 53 of the arm 51 which moves near the neighboring plate.

In FIG. 1, it is seen that in the method of carrying out the invention shown the plates of the extremities A and D only support one arm 51 articulated at 52, while the intermediate plates B and C each support two articulated arms 51, each directed towards a neighboring plate.

It will be noticed that roller straighteners 55 are distributed regularly on either side of the straightening axis 50 and that in this direction they are equidistant.

In fact, when considering the space between the plates A and B and if it is admitted that at first estimation the extremity 53 of the arm 51 moves on the plate B, it is found that the roller 55 of the plate A is situated at a quarter of the length of the arm 51, thus at a quarter of the distance between the plates A and B.

In the same way, the roller 55 which is mounted onto the arm articulated onto the plate B is situated at three quarters of the distance between the plates A and B.

Obviously these are approximate positions of the rollers, because to carry out a straightening, as is well known, it is necessary for the rollers at the entry of the straightener to be closer to the axis 50 than at the exit.

Now consider that from the position shown with solid lines in FIG. 1 the various plates B, C and D are moved to the right keeping them at equal distances.

To do this, if the plate B is moved 4 cms for example, the plate C must be moved 8 cms and the plate D must be moved 12 cms as is shown with broken lines.

The result of this increase of the distance between the plates is that on the one hand the rollers get closer to the axis 50 by the same distance because the structure of the device is perfectly symmetrical for example about the axis 50. Another result is that the distance between two rollers parallel to the axis 50 varies proportionally to the distance that is between the various plates A, B, C, D.

Bearing the above in mind, it will be seen that for movements of the plates B, C and D of respectively 4,8 and 12 cms, the roller 55 borne by the plate A moves by 1 cm because it is at the first quarter of the arm which connects the plate A with the plate B, while the second roller which is borne by the plate B moves by 3 cms because it is at three quarters of the distance between these plates. In the same way, the following rollers move by 5, 7, 9 and 11 cms, the effect of which is to keep the distance between the rollers equal and to maintain the symmetry of the rollers relative to the points of the axis 50 which are at equidistance from two neighboring plates.

Figure 2:
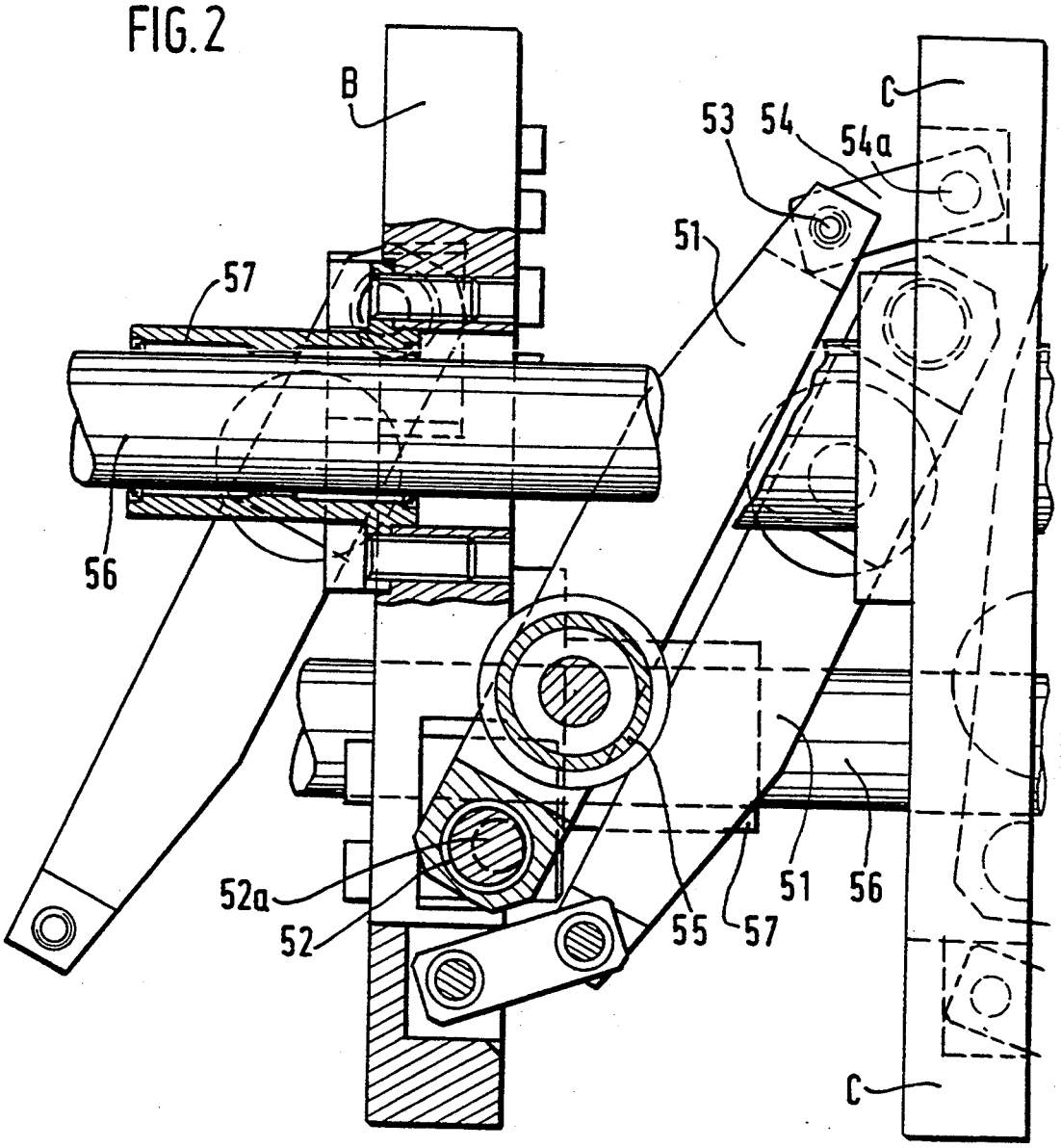
FIG. 2 is a partial section elevation view of the roller-bearing arms which connect two neighboring plates.

In FIG. 2, the same two plates B and C are shown which slide on cylindrical shafts 56 by means of sockets 57. The pivoting arm 51 is articulated to the plate B at 52, by means of an eccentric **52*a* which enables the distance of the roller 55 from the axis 50** of the straightener to be preset.

The eccentrics **52*a*** enable the deformations exerted by each roller during straightening to be set a priori, this setting can then be retained when the plates are moved in accordance with the invention to adapt the straightener to products to be straightened which have different diameters.

This presetting of the position of the rollers can also be achieved by modifying the position of the rollers relative to the arms which support them.

The free extremity 53 of the arm 51 is connected by the small rod 54 to the point of articulation **54*a*** of the plate C.

In accordance with the invention, the distance between the axis of articulation of the roller 55 and the axis of articulation 52 of the arm 51 onto the plate B is essentially equal to a quarter of the distance between the axis of articulation 53 of the other extremity of the arm 51.

In FIG. 2, it will also be seen how a second roller is supported between the plates B and C by being fixed at the quarter point of the arm 51 which is articulated onto the plate C.

For reasons explained below with reference to FIG. 1, as an initial approximation it can be considered that the kinematics of the system according to the invention are such that on the one hand there is perfect symmetry when rollers between two neighboring plates are moved and on the other hand the various rollers move towards or away from the axis of the straightener in the same way. In this way, the progressivity of the deformations which were obtained by setting the eccentrics (**52*a***), is retained.

Figure 3:
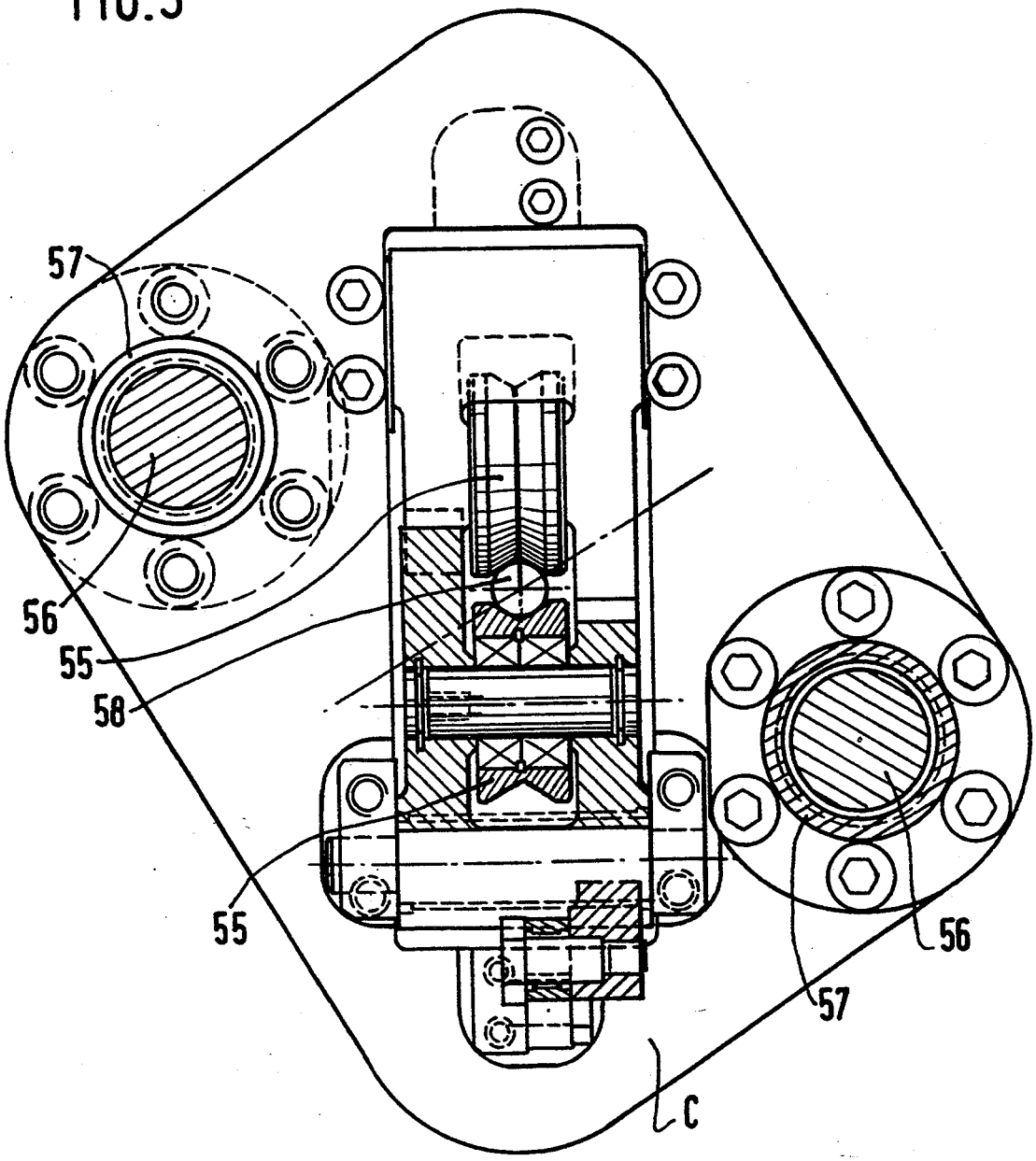
FIG. 3 is a transverse section view of the device of FIG. 2.

In FIG. 3, an elevation of the plate C is shown with the cylindrical bars 56 on which the plates slide by means of rings 57. Also shown in this figure ~~are~~ two rollers 55, the axis of which are in different planes, which ensure a permanent deformation by flexion of the product to be straightened 58, this obviously in cooperation with a third roller, not shown.

Figure 4:
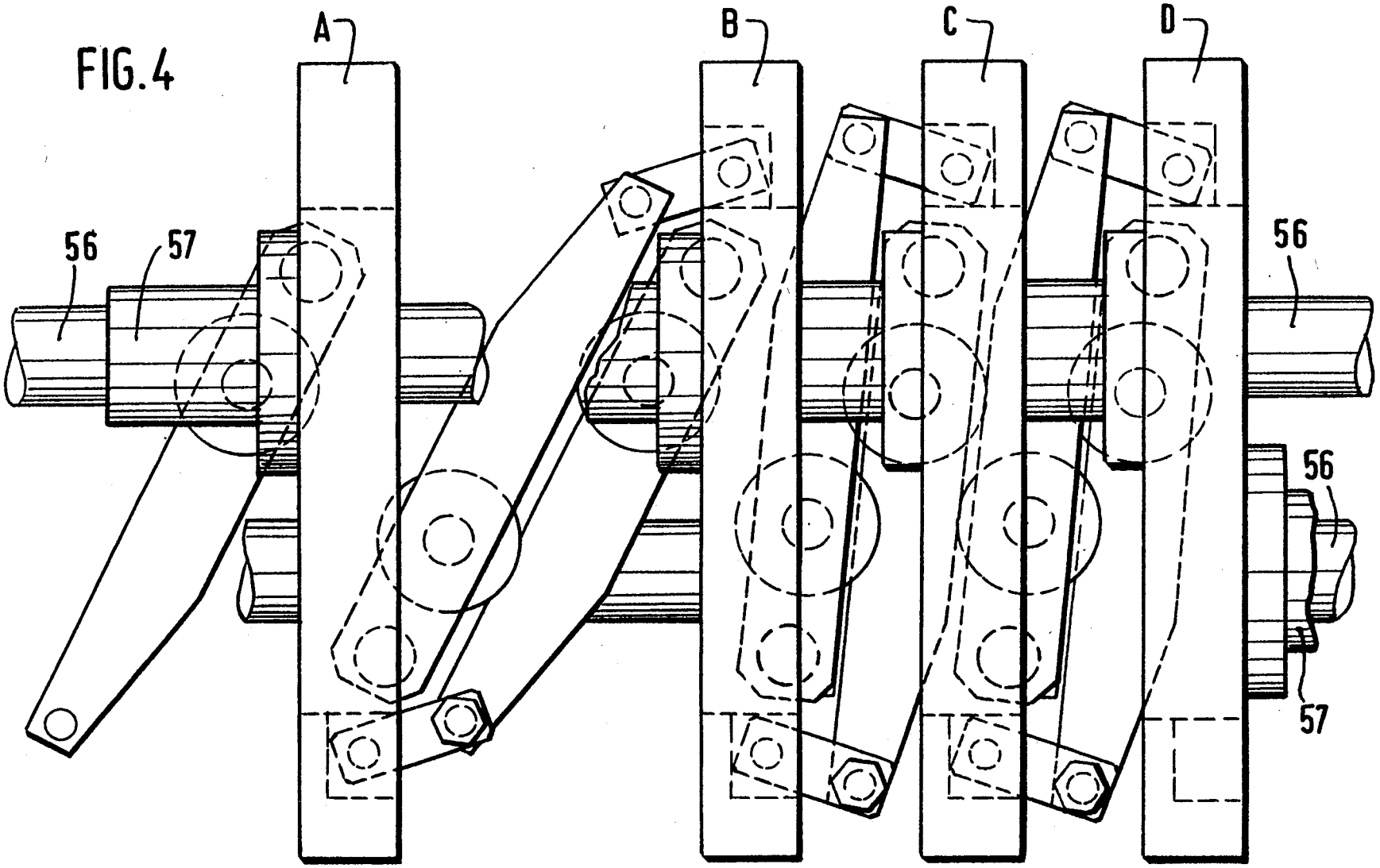
FIG. 4 is an elevation view of the assembly of plates arranged at regular intervals.

In FIG. 4 an elevation view of a straightener is shown with four plates, A, B, C, D, the plates C, D being as close as possible and the plates A and B being as far apart as possible, this is to demonstrate the possible extent of clearances.

This drawing clearly shows that the plates must be close together for straightening light products, while they have to be far apart of straightening heavier products.

As has been explained above, the maintenance of essentially equal distances between the plates when the straightener is adjusted to suit the diameter of the product to be straightened, is one of the essential conditions of the invention.

Figure 5:
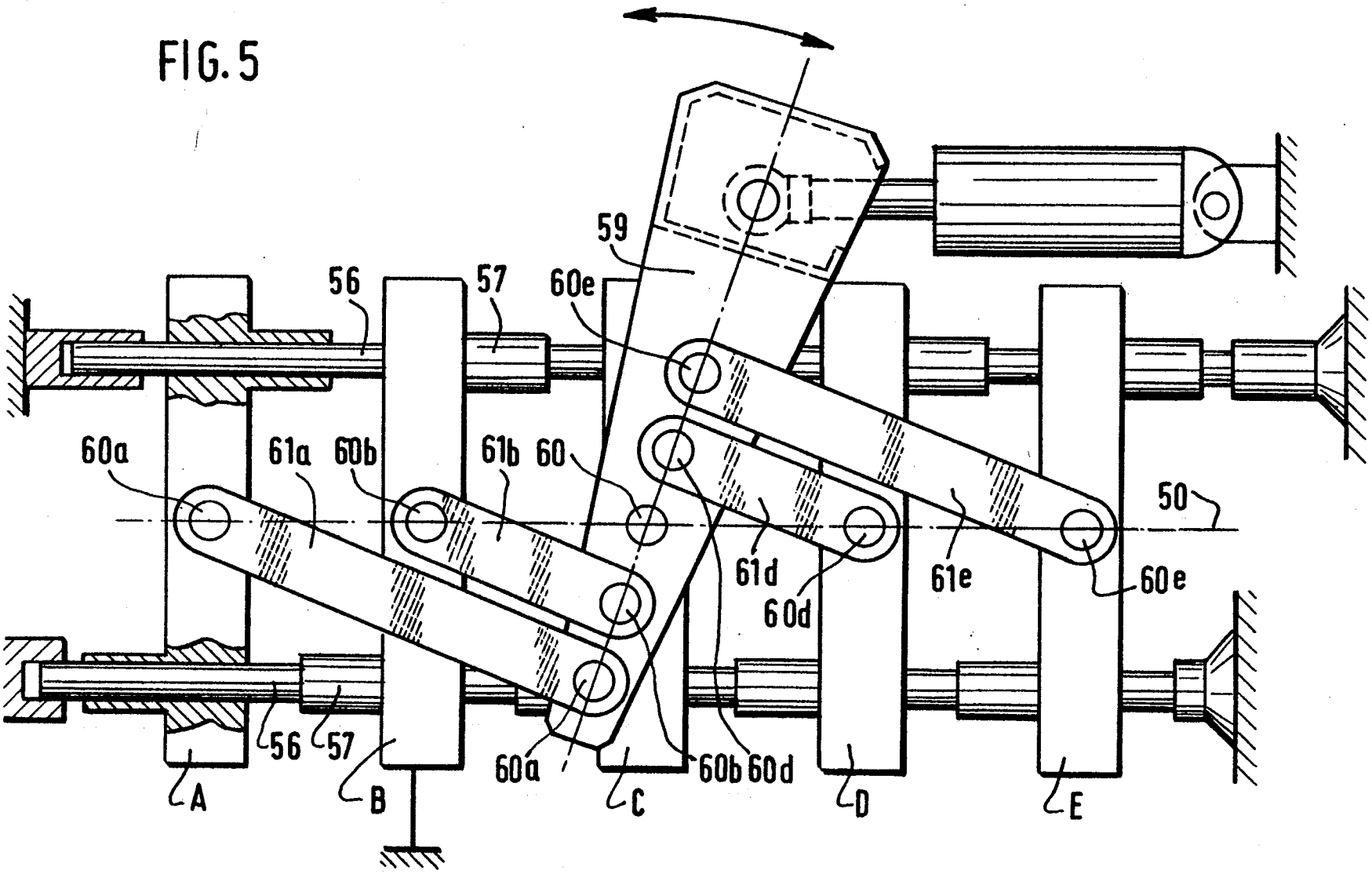
FIG. 5 is a lateral view showing a device according to the invention which enables an equal distance to be ensured between the plates.

This can be achieved by various means, but a preferred method according to the invention is shown in FIG. 5.

This figure is a diagram of five plates, A, B, C, D, E which slide on shafts as has been explained above.

It is assumed that the plate B is immobilized and that the other plates can move relative to it.

A rocking lever 59 is articulated at 60 onto the plate C in the plane of the axis 50 of the trimmer. This lever 59 is connected to the plates A, B, D, E, by small rods 61*a*, 62*b*, 60*d*, and 60*e* of the lever 59, the other extremity of each small rod being connected to the plates A, B, D, E at the points 62*a*, 62*b*, 62*d* and 62*e* situated in the plane of the axis of the straightener.

As is seen in FIG. 5, the points of articulation 60, 60*a*, 60*b*, 60*d* and 60*e* are equidistant from each other, as also are the points of articulation 62*a*, 62*b*, 62*d* and 62*e* situated in the axial plane of the straightener.

The result is that if the oscillating arm 59 is made to pivot in the direction of the double arrow F, for example by means of an hydraulic jack 63, the plates A, C, D, E slide by distances which in the first place are approximately proportional to the distance between the axis 60 and the points of attachment of the small rods 60*a*, 60*b*, 60*d* and 60*d*.

As these pivoting points of the small rods are equidistant from each other, the result is that the plates A, B, C, D, E remain equidistant when their spacing is adjusted.

In this method of carrying out the invention which ensures that the plates remain equidistant from each other, it also possible to put a roller-bearing arm (51) on each of the terminal faces of the extremity plates (A and D, FIG. 1) by reuniting the extremity 53 of the arms at a point on the lever 59 chosen according to the same rule as for the points 60*a*, 60*b*, 60*d* and 60*e* by means of a small rod analogous to the small rods 61*a*, 61*b*, 61*d* and 61*e*.

In accordance with the invention, it is useful but not essential for the axis of articulation 60 of the lever 59 to be situated on a plate, this simplifies the structure of the device. It is also preferable for this axis of articulation 60 to be situated essentially in the middle of the straightener.

Moreover, when the axis of articulation 60 of the lever 59 is situated on a plate, this plate can be fixed, but it can also be able to slide on condition that another plate is fixed, such as the plate B in FIG. 5.

It has been shown that the invention makes it possible by simple and reliable means to regulate the position of rollers Obviously, the method of carrying out the invention described above was only given by way of illustration and could be modified without however departing from the scope of the invention.

What is claimed is:

1. A straightener for straightening products such as steel bars for concrete comprising: a path extending through the straightener having a center line such that the axis of the product corresponds to the path center line, a plurality of plates displaceable relative to one another while remaining perpendicular to the axis of the product to be straightened; means for displacing said plates in the direction of said axis so that the distance between the plates is modified and so that said plates remain equidistant from each other in order to adapt the straightener to various different products to be straightened, each plate being connected to the adjacent plates by two roller bearing arms having each a first end pivoting on a fixed point of a first plate and a second end connected to a second adjacent plate by means allowing the displacement of said second end in the vicinity of said adjacent plate when the distance between the two plates is modified, each roller bearing arm supporting a straightening roller having a rotation axis, the rotation axis of which is located at a distance from said pivoting point of the roller bearing arm on said first plate which is a quarter of the length of said roller bearing arm, said rollers being located on said roller bearing arms so that the rollers are positioned on both sides of the path center line and modifying the distance between the plates results in moving all the rollers equal distances relative to the path center line.

2. A straightener according to claim 1, wherein said first end of each roller bearing arm pivots on said first plate by means of an eccentric allowing a fine positioning of the roller relative to the axis of the product to be straightened.

3. A straightener according to claim 1, wherein said second end of each roller bearing arm is connected to a fixed point of the adjacent plate by means of a short rod having one end articulated on the second end of the roller bearing arm and the other end articulated on the adjacent plate.

4. A straightener according to claim 1, wherein said means for displacing the plates in the direction of the axis of the product to be straightened while said plates remain equidistant comprises: a lever oscillating around an axis parallel to the plates; and means for actuating said oscillating lever in order to adapt the straightener to the various products to be straightened, said oscillating lever being connected to each plate by a connecting rod, the distance between the pivoting points of two adjacent rods on the oscillating lever and between the pivoting point of the oscillating lever and the pivoting point of the adjacent rod, being the same for all rods, the length of any connecting rod being equal to the length of the connecting rod connecting the pivoting point of the oscillating lever with the adjacent plate multiplied by the number of plates situated between the pivoting point of the oscillating lever and the plate connected by the concerned rod plus one.

5. A straightener according to claim 4, wherein the pivoting point of the oscillating lever is located on a plate, one of the plates being maintained in a fixed position.

6. A straightener according to claim 4, wherein the pivoting point of the oscillating lever is located in the middle of the straightener.

7. A straightener according to claim 5, wherein the oscillating lever pivots around a point located on the plate which is maintained in a fixed position.

8. A straightener according to claim 2, wherein said second end of each roller bearing arm is connected to a fixed point of the adjacent plate by means of a short rod having one end articulated on the second end of the roller bearing arm and the other end articulated on the adjacent plate.

9. A straightener according to claim 2, wherein said means for displacing the plates in the direction of the axis of the product to be straightened while said plates remain equidistant comprises: a lever oscillating around an axis parallel to the plates; and means for actuating said oscillating lever in order to adapt the straightener to the various products to be straightened, said oscillating lever being connected to each plate by a connecting rod, the distance between the pivoting points of two adjacent rods on the oscillating lever and between the pivoting point of the oscillating lever and the pivoting point of the adjacent rod, being the same for all rods, the length of any connecting rod being equal to the length of the connecting rod connecting the pivoting point of the oscillating lever with the adjacent plate multiplied by the number of plates situated between the pivoting point of the oscillating lever and the plate connected by the concerned rod plus one.

10. A straightener according to claim 3, wherein said means for displacing the plates in the direction of the axis of the product to be straightened while said plates remain equidistant comprises: a lever oscillating around an axis parallel to the plates; and means for actuating said oscillating lever in order to adapt the straightener to the various products to be straightened, said oscillating lever being connected to each plate by a connecting rod, the distance between the pivoting points of two adjacent rods on the oscillating lever and between the pivoting point of the oscillating lever and the pivoting point of the adjacent rod, being the same for all rods, the length of any connecting rod being equal to the length of the connecting rod connecting the pivoting point of the oscillating lever with the adjacent plate multiplied by the number of plates situated between the pivoting point of the oscillating lever and the plate connected by the concerned rod plus one.

11. A straightener according to claim 5, wherein the pivoting point of the oscillating lever is located in the middle of the straightener.

* * * * *